US010052594B2

(12) United States Patent
B R et al.

(10) Patent No.: US 10,052,594 B2
(45) Date of Patent: Aug. 21, 2018

(54) APPARATUS FOR PROCESSING SLURRY AND A PROCESS THEREOF

(71) Applicants: Chethan Ravi B R, Chikmangalur (IN); Anant Kumar Mishra, Bangalore (IN); Sudev Nair, Bangalore (IN)

(72) Inventors: Chethan Ravi B R, Chikmangalur (IN); Anant Kumar Mishra, Bangalore (IN); Sudev Nair, Bangalore (IN)

(73) Assignee: SIEMENS HEALTHCARE DIAGNOSTICS INC., Tarrytown, NY (US)

( * ) Notice: Subject to any disclaimer, the term of this patent is extended or adjusted under 35 U.S.C. 154(b) by 130 days.

(21) Appl. No.: 14/997,922

(22) Filed: Jan. 18, 2016

(65) Prior Publication Data

US 2017/0203266 A1 Jul. 20, 2017

(51) Int. Cl.

| | |
|---|---|
| ***B01F 3/00*** | (2006.01) |
| ***B01F 15/00*** | (2006.01) |
| ***B01F 3/12*** | (2006.01) |
| ***B01F 3/14*** | (2006.01) |
| ***B01F 7/24*** | (2006.01) |
| ***B01F 15/06*** | (2006.01) |
| ***B01F 7/00*** | (2006.01) |
| ***B01F 7/16*** | (2006.01) |
| ***B01F 7/22*** | (2006.01) |
| ***B01F 15/02*** | (2006.01) |

(52) U.S. Cl.

CPC ..... *B01F 3/1221* (2013.01); *B01F 3/14* (2013.01); *B01F 7/00633* (2013.01); *B01F 7/161* (2013.01); *B01F 7/22* (2013.01); *B01F 7/242* (2013.01); *B01F 15/0278* (2013.01); *B01F 15/065* (2013.01); *B01F 2003/125* (2013.01); *B01F 2015/061* (2013.01); *B01F 2215/0036* (2013.01)

(58) Field of Classification Search

CPC .... B01F 7/161; B01F 7/00633; B01F 3/1221; B01F 3/14; B01F 7/22; B01F 7/242; B01F 15/0278; B01F 15/065; B01F 2003/125; B01F 2015/061; B01F 2215/0036

See application file for complete search history.

(56) References Cited

U.S. PATENT DOCUMENTS

| | | | | |
|---|---|---|---|---|
| 3,954,722 A * | 5/1976 | Echte | C08F 2/02 526/227 |
| 2013/0134619 A1* | 5/2013 | Alsewailem | B29B 7/16 366/77 |
| 2014/0369158 A1 | 12/2014 | Engenhart | |

FOREIGN PATENT DOCUMENTS

| | | |
|---|---|---|
| DE | 2922263 A1 | 12/1980 |
| DE | 102011018433 A1 | 10/2012 |
| FR | 2684087 A1 | 5/1993 |

* cited by examiner

*Primary Examiner* — Anshu Bhatia

(74) *Attorney, Agent, or Firm* — Lempia Summerfield Katz LLC

(57) ABSTRACT

An apparatus and a method for processing slurry are provided. The apparatus includes a support frame including a vertical member and a horizontal member. The apparatus also includes a mounting unit mounted on the vertical member, a mixing chamber disposed on the horizontal member, a controller mounted on the mounting unit, and a stirrer attached to the controller. The mounting unit is operable to position the stirrer with respect to the mixing chamber such that the stirrer is in contact with a slurry in the mixing chamber during the mixing operation.

16 Claims, 6 Drawing Sheets

APPARATUS FOR PROCESSING SLURRY AND A PROCESS THEREOF

BACKGROUND

The present embodiments relate to processing slurry.

For the processing of slurry, the apparatus used is to be capable of handling high viscosity, reducing contact of the slurry with the external environment, handling high torque, and is to be versatile. When a substance is mixed with a solvent during the processing of slurry, it is important that the substance be uniformly mixed with the solvent. The substance to be mixed with the solvent may be a nano-sized powder and possesses hazardous properties. Thus, these substances are to be handled in a safe manner such that the interaction with the environment is minimal. On mixing of such nano-sized particles with the solvent, the viscosity of the slurry may increase.

A variety of apparatuses for stirring substances into a solvent are commercially available. These apparatuses require manual handling and are suitable for handling mixtures with low viscosity. These apparatus include a stirrer with a single or multiple stirrer blades, that is attached manually into a container containing the substance to be mixed along with the solvent. Also, these stirrers lack the ability to handle the change in viscosity of the slurry during the course of mixing. The apparatus, when used for mixing substances with hazardous properties, do not have the capability to reduce interaction with the environment due to stirring. Due to a single stirrer blade, the mixing of the mixture or slurry may not be efficient. The stirrers of the commercially available apparatuses are fixed and therefore do not permit vertical movement of the stirrer with respect to the slurry. Thus, the removal of the mixture or slurry upon mixing becomes difficult and may increase the chance of interaction with the environment. As the stirrer shaft is fixed, cleaning the stirrer becomes a cumbersome activity.

During the operation of the apparatus, there is a likelihood of movement of the mixing chamber due to high torque introduced during the course of mixing. This results in frequent displacement of the mixing chamber and a need to reposition the mixing chamber at short intervals. These apparatuses also do not provide for maintaining the temperature of the stirring bath.

SUMMARY

The scope of the present invention is defined solely by the appended claims and is not affected to any degree by the statements within this summary.

An apparatus and a method for handling slurry are disclosed. In one aspect, an apparatus includes a mounting unit mounted on a support frame, a mixing chamber mounted on the support frame, and a stirrer coupled with a control unit mounted on the mounting unit. The stirrer is adapted to come in contact with the slurry in the mixing chamber.

In another aspect, the apparatus includes a mounting unit mounted on a support frame, and a mixing chamber mounted on the support frame. The mixing chamber has an outlet at the bottom. The mixing chamber also has an inlet and an outlet on the walls for inflow and outflow of fluid, respectively, for temperature maintenance. The apparatus also includes a stirrer coupled with a control unit mounted on the mounting unit. The stirrer is adapted to come in contact with the slurry in the mixing chamber and a squeezer unit mounted on a mounting unit. The squeezer unit is adapted to come in contact with the slurry in the mixing chamber.

In yet another aspect, a method includes mixing a substance with a solvent in a mixing chamber using a stirrer mounted on a mounting unit to form a slurry thereby. The stirrer is removed from the contact of the slurry, and the mounting unit is adapted so as to bring the squeezer in contact of the slurry. The slurry is squeezed in the mixing chamber using the squeezer to remove the slurry from the bottom outlet of the mixing chamber.

BRIEF DESCRIPTION OF THE DRAWINGS

The present disclosure is further described hereinafter with reference to illustrated embodiments shown in the accompanying drawings, in which.

DETAILED DESCRIPTION

Figure 1:
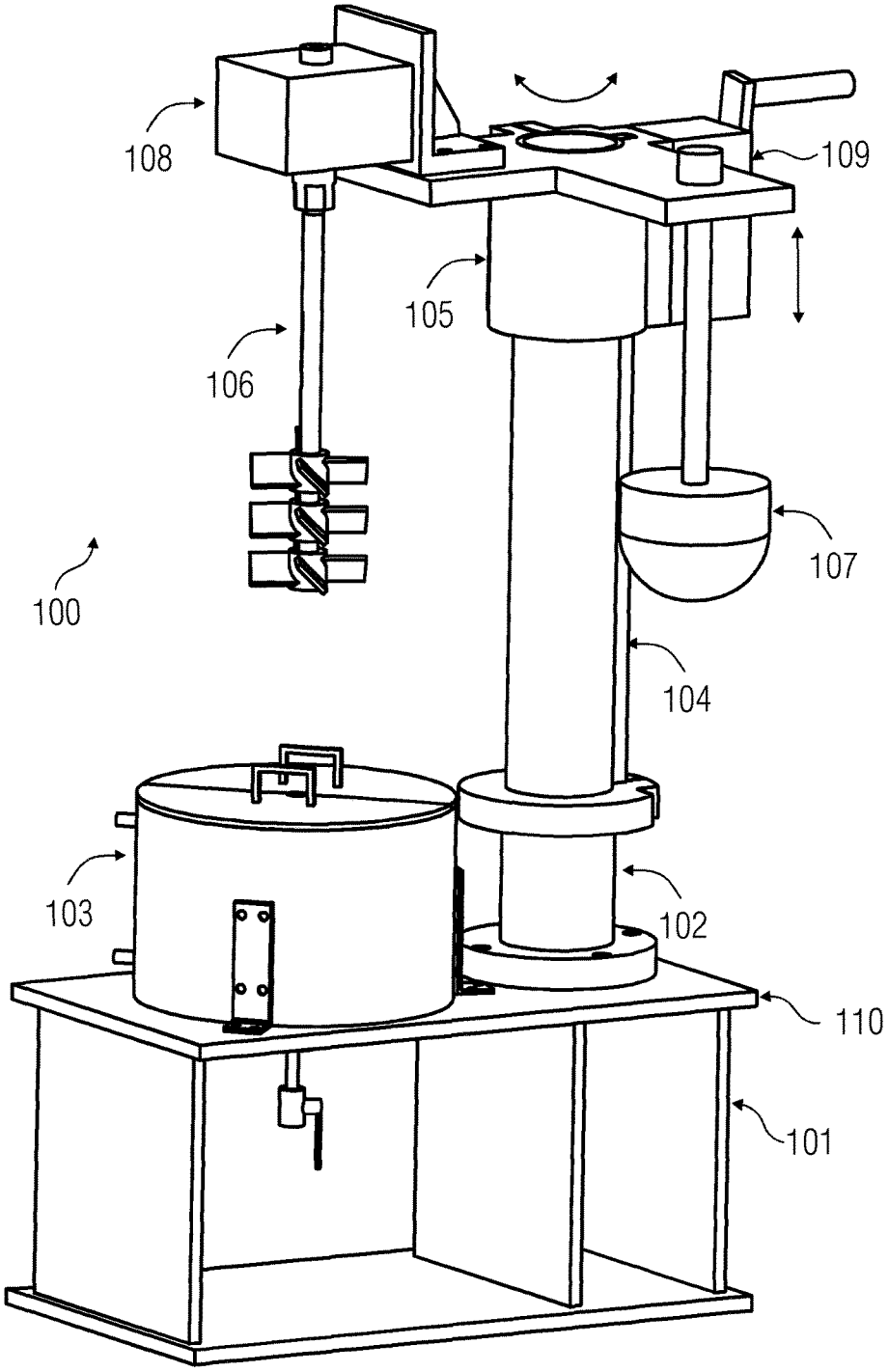
FIG. 1 illustrates an apparatus for processing slurry, according to an embodiment.

An apparatus and process of processing slurry is disclosed. Hereinafter, embodiments for carrying out the present disclosure are described in detail. The various embodiments are described with reference to the drawings, where like reference numerals are used to refer to like elements throughout. In the following description, for purpose of explanation, numerous specific details are set forth in order to provide a thorough understanding of one or more embodiments. It may be evident that such embodiments may be practiced without these specific details.

FIG. 1 illustrates a block diagram of an apparatus 100 for processing slurry, according to an embodiment. The apparatus 100 includes a support frame 101, a mixing chamber 103, a mounting bracket 105, a stirrer unit 106, a squeezer unit 107, a control unit 108 (e.g., a controller), and a driving unit 109. The support frame 101 is steel reinforced and has a stress relieved structure. The support frame 101 has a vertical member 102 and a horizontal member 110. The vertical member 102 is coupled to a stop ring. The vertical member 102 includes a rack 104, on which a mounting unit 105 is mounted. The mounting unit 105 includes a mounting bracket. A mounting bracket 105 is a load bearing horizontal support fitting that has slots for mounting of other elements of the apparatus 100. The mounting bracket 105 is fitted to the rack 104 by a rack and pinion arrangement. The control unit 108 is mounted on the mounting bracket 105, and the stirrer 106 is connected to the control unit 108. An exemplary construction of the stirrer 106 is explained in detail with reference to FIG. 2. The squeezer unit 107 is mounted on the mounting bracket 105. An exemplary construction of the stirrer 106 is explained in detail with reference to FIG. 7. The control unit 108 may include an electric motor coupled with a gear box and variable frequency drive to control the speed of the stirrer 106. The speed regulator in the control unit 108 helps in achieving the requirement of speed control of the stirrer 106. The speed of the stirrer 106 may be controlled depending upon various factors (e.g., the type and size of the substance required to be mixed, or the viscosity of the slurry). A driving unit 109 is coupled to the mounting bracket 105 such that the driving unit 109 allows vertical movement of the mounting bracket 105 along the rack 104. The mounting bracket 105 is rotatable on the rack 104 such that the stirrer 106 and the squeezer unit 107 may be repositioned with respect to the mixing chamber 103. On the horizontal member 110 of the support frame 101, a mixing chamber 103 is mounted.

In operation, in the apparatus 100, the substance and the solvent to be mixed are added into the mixing chamber 103. The stirrer 106 mounted on the mounting bracket 105 is brought in contact with the mixing chamber 103 using the driving unit 109. The stirrer 106 is rotated using the control unit 108 to form the slurry. Slurry is a thick mixture of solvent and other substances and may be of varying viscosities. After the slurry is formed, the stirrer 106 is repositioned using the driving unit 109 so as to remove the contact between the stirrer 106 and the slurry. This provides reduced contact of the slurry with the environment. The mounting bracket 105 is rotated by loosening a bolt mounted on the mounting bracket 105 to bring about 90° rotation of the mounting bracket 105 about a horizontal plane so as to align the squeezer unit 107 with the mixing chamber 103. The driving unit 109 is used to bring the squeezer unit 107 in contact with the slurry in the mixing chamber 103, and the slurry is then squeezed from the mixing chamber 103. The slurry is then removed from the mixing chamber 103 for further processing.

Figure 2:
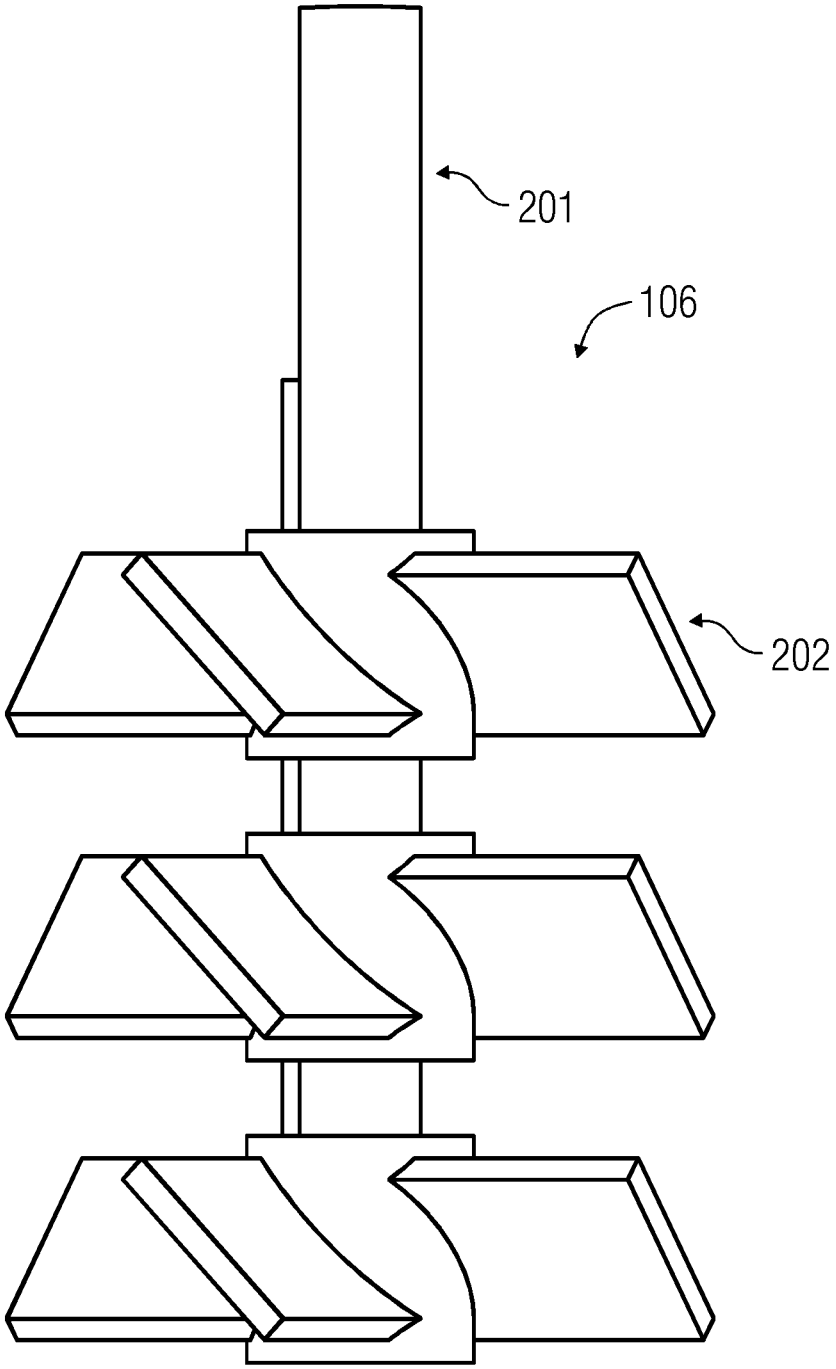
FIG. 2 illustrates a front view of the stirrer of the apparatus, according to an embodiment.

FIG. 2 illustrates a front view of the stirrer 106 of the apparatus 100, according to an embodiment. The stirrer 106 includes of a stirrer shaft 201 and one or more stirrer blades 202 affixed to the stirrer shaft 201. The stirrer shaft 201 is made of a metal or an alloy and is non-corrosive and non-reactive. The surface of the stirrer shaft 201 may be ridged so as to allow locking of the stirrer blades 202 in a fixed position. This prevents loosening of the stirrer blades 202. In an embodiment, three stirrer blades 202 are arranged in series on the shaft 201. This increases the stirring capacity of the stirrer 106. The number of the stirrer blades 202 may be increased depending upon the quantity of slurry to be produced. Series arrangement of the stirrer blades 202 makes possible effective utilization of space. The stirrer blades 202 arranged in series also allows homogenous mixing of the slurry and creation of required turbulence. The quality of the slurry is also enhanced. Alternatively, the stirrer blades 202 may also be arranged in parallel.

Figure 3A:
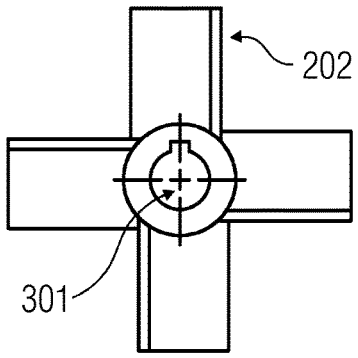
FIG. 3A illustrates a top view of a stirrer blade of the apparatus, according to an embodiment.
Figure 3B:
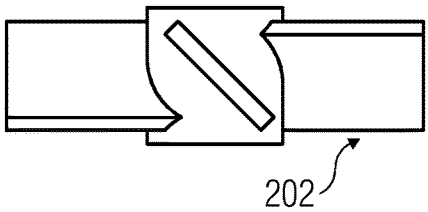
FIG. 3B illustrates a side view of the stirrer blade of the apparatus, according to an embodiment.
Figure 3C:
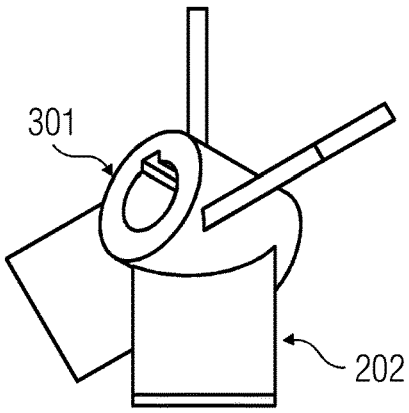
FIG. 3C illustrates a perspective view of the stirrer blade of the apparatus, according to an embodiment.

FIGS. 3A, 3B, and 3C illustrate various perspectives of the stirrer blade 202, such as those shown in FIG. 2. FIG. 3A illustrates a top view of a stirrer blade 202 of the apparatus 100, according to an embodiment. The stirrer blade 202 includes a wheel hub that has a central hole 301 that is used for connecting to the stirrer shaft 201. The central hole 301 has a slot so as to accommodate the ridge on the stirrer shaft 201. FIGS. 3B and 3C depict the angular structure of the stirrer blades. The blades are positioned at an angle greater than 90° made with the horizontal axis of the wheel hub. The stirrer blades 202 are helical in pattern. The suitable blade angle provides for efficient mixing of viscous fluids. The blades are designed with running clearance between blade tip to inner wall.

Figure 4:
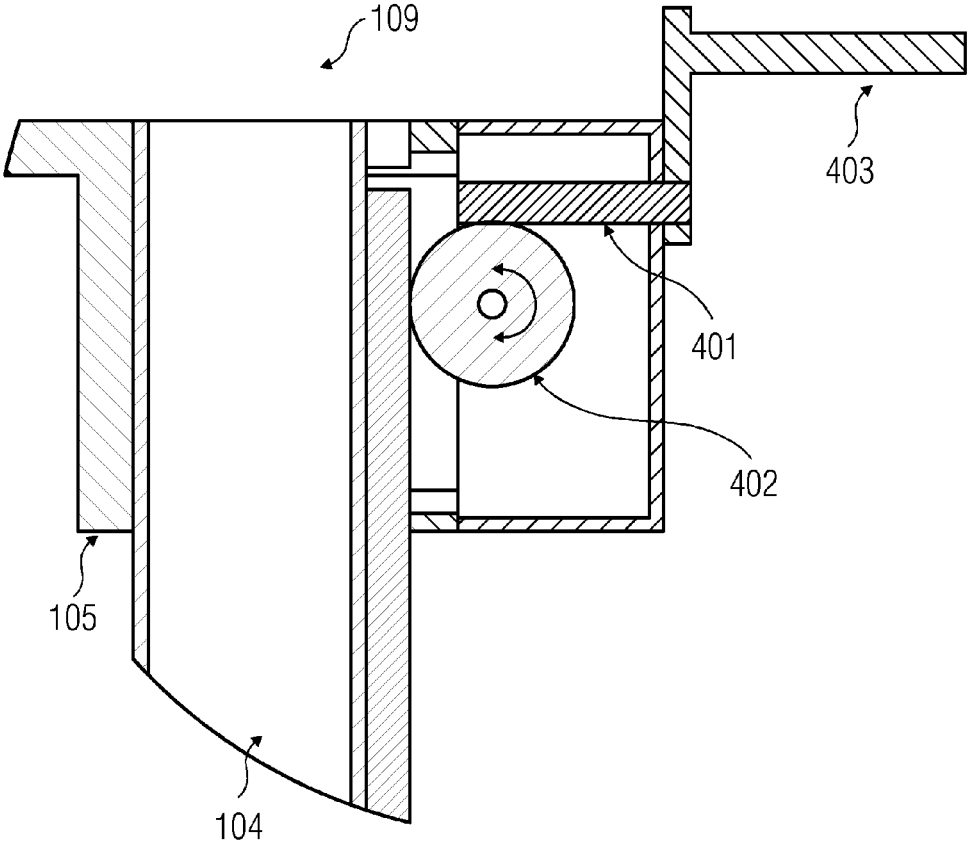
FIG. 4 illustrates a driving unit of the apparatus, according to an embodiment.

FIG. 4 illustrates a view of the driving unit 109 of the apparatus 100, according to an embodiment. The driving unit 109 is attached to the mounting bracket 105 and thereby helps in vertical movement of the mounting bracket 105 along the rack 104. The driving unit 109 includes a worm 401 and a worm wheel 402. The worm 401 is coupled with a handle 403 that may be used to rotate the worm wheel 402. During this motion, the mounting bracket 105 that carries the stirrer 106 and the squeezer unit 107 moves up and down vertically. For example, the rotation of the worm wheel 402 in a single direction moves the mounting bracket downwards, whereas rotation of the worm wheel 402 in the opposite direction moves the mounting bracket 105 upwards. Alternatively, the motion of the mounting bracket 105 may be motorized.

Figure 5:
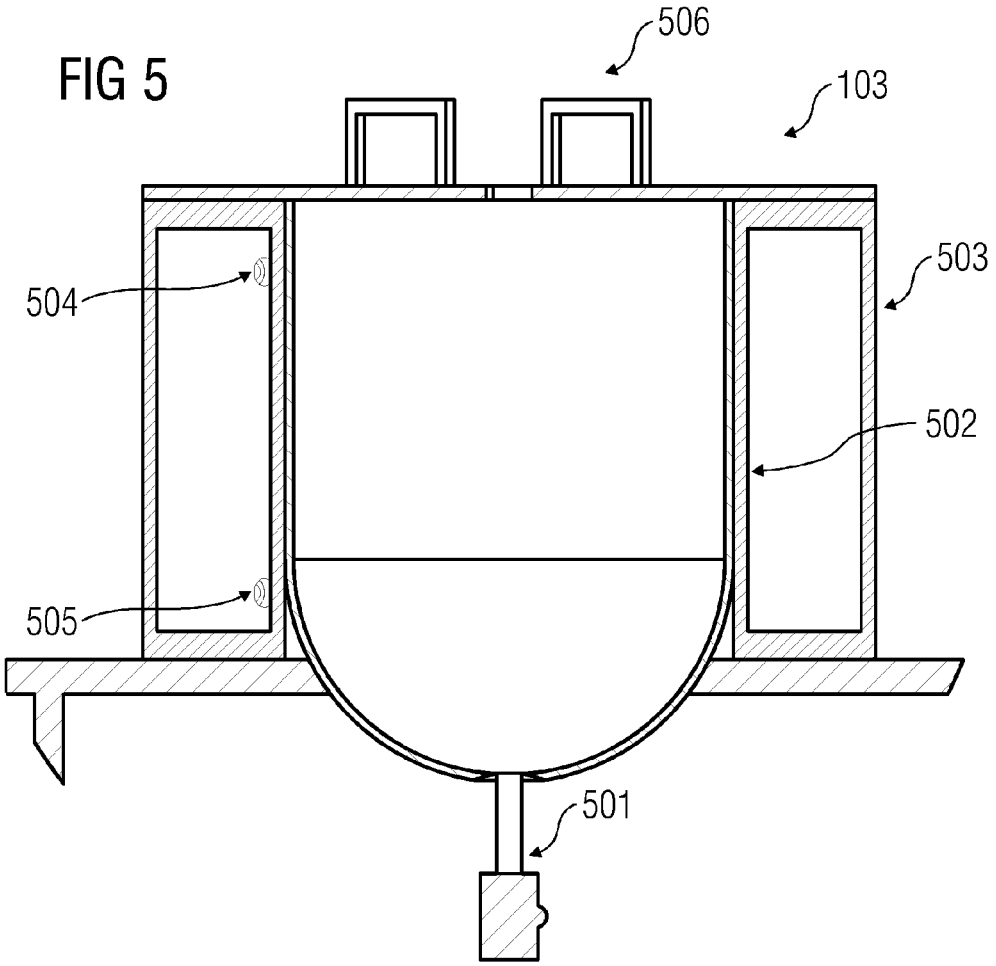
FIG. 5 illustrates a cross sectional view of the mixing chamber of the apparatus according to an embodiment.

FIG. 5 illustrates a cross section view of a mixing chamber 103 of the apparatus 100, according to an embodiment. The mixing chamber 103 plays an important role in preparing homogenous slurry using the apparatus 100. The mixing chamber 103 has two cylindrical side walls and a concave bottom wall. The two cylindrical side walls of the mixing chamber 103 include an inner cylindrical wall 502 and an outer cylindrical wall 503. The outer cylindrical wall 503 has an inlet pipe 504 and an outlet 505 through which fluid may be input and output, respectively. This helps maintain the temperature of the mixing chamber 103. Alternatively, a cooling unit may also be placed between the inner and the outer cylindrical walls of the mixing chamber 103 such that the cooling unit is thermally coupled with the mixing chamber 103. Alternatively, the temperature of the mixing chamber 103 may also be maintained by inflow and outflow of fluids with pre-determined temperature. The mixing chamber 103 is made of a material that is non-corrosive and non-reactive. The bottom wall of the mixing chamber 103 has an outlet 501 for the outflow of the homogenous slurry from the mixing chamber 103. The outlet 501 has a valve to control the outflow of the homogenous slurry. Some of the examples of the type of valves that may be used are a ball valve, a plastic valve, a gate valve, and the like. The mixing chamber 103 includes a lid 506 that may be used to safely cover the slurry in the mixing chamber 103 and reduce exposure of the slurry to the outer environment.

Figure 6:
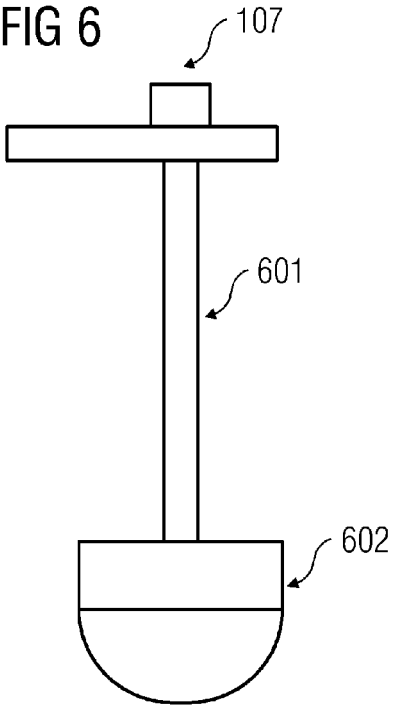
FIG. 6 illustrates a front view of a squeezer of the apparatus, according to an embodiment.

FIG. 6 illustrates a perspective view of squeezer unit 107 of the apparatus 100, according to an embodiment. The squeezer unit 107 includes a shaft 601 to which a squeezer 602 is attached. The shaft 601 is a cylindrical rod that is non-reactive and non-corrosive. The squeezer unit 107 is mounted on the mounting bracket 105. The squeezer 602 attached to the shaft 601 is used to squeeze the slurry from the mixing chamber 103. The squeezer 602 is a semispherical solid that is also non-reactive and non-corrosive. The bottom of the squeezer unit 107 has the same profile compared to the bottom of the mixing chamber 103 for increasing material yield. In operation, the squeezer 602 is brought into contact with the slurry by lowering the mounting bracket 105 into the mixing chamber 103. Accordingly, the squeezer 602 then pushes the slurry by application of pressure. As a result, the slurry is removed through the bottom outlet 501 of the mixing chamber 103.

Figure 7:
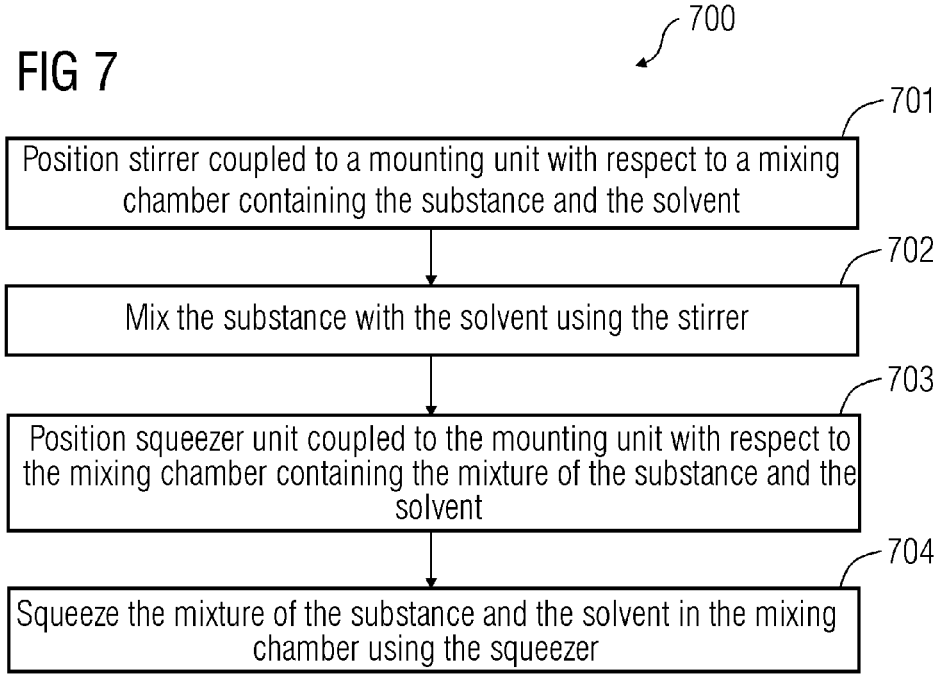
FIG. 7 illustrates a flow chart of a method for processing slurry, according to an embodiment.

FIG. 7 illustrates a flow chart 700 of a method of handling slurry, according to an embodiment. At act 701, a stirrer 106 coupled to a mounting unit 105 is positioned with respect to a mixing chamber 103 that contains substance and solvent. The substance to be mixed with a solvent is mixed in the mixing chamber 103 using the stirrer 106 at act 702. The speed of the stirrer 106 may be controlled using the electric motor coupled with a gear box 108 that is attached to the stirrer 106. The height of the stirrer 106 may be adapted by moving the mounting bracket 105 vertically using the driving unit 109. The temperature of the mixing chamber 103 may be maintained using a cooling unit if the slurry is to be prepared at a constant temperature. Once the slurry is formed, the stirrer is removed from the contact of the slurry. The handle 403 of the driving unit 109 may be rotated to bring the stirrer away from the contact of the formed slurry. If the slurry is to be removed from the mixing chamber 103, the mounting unit 105 may be adapted to position a squeezer 107 with respect to the mixing chamber 103 such that the squeezer 107 is in contact with the slurry in the mixing chamber 103 at act 703. The slurry is then squeezed from the mixing chamber 103 to remove the slurry from the bottom outlet 501 at act 704.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. An apparatus comprising:

a support frame comprising a vertical member and a horizontal member;

a mounting unit mounted on the vertical member of the support frame;

a mixing chamber disposed on the horizontal member of the support frame;

a controller mounted on the mounting unit;

a stirrer attached to the mounting unit, wherein the mounting unit is operable to position the stirrer with respect to the mixing chamber such that the stirrer is in contact with a slurry in the mixing chamber during a mixing operation; and a squeezer unit mounted on the mounting unit, wherein the squeezer unit is semispherical in shape.

2. The apparatus of claim 1, wherein the controller is operable to rotate the stirrer about a rotational axis of the stirrer during the mixing operation.

3. The apparatus of claim 1, wherein the mounting unit is operable to position the squeezer unit with respect to the mixing chamber such that the squeezer unit is in contact with the slurry in the mixing chamber.

4. The apparatus of claim 1, further comprising:

a driving unit coupled to the mounting unit and operable to position the mounting unit along the vertical member of the support frame.

5. The apparatus of claim 4, wherein the mounting unit is rotatable around the vertical member of the support frame in a horizontal plane so as to reposition the stirrer and the squeezer unit with respect to the mixing chamber.

6. The apparatus of claim 1, wherein the stirrer comprises a stirrer shaft and one or more stirrer blades affixed on the stirrer shaft.

7. The apparatus of claim 6, wherein the one or more stirrer blades are arranged in a helical pattern.

8. The apparatus of claim 6, wherein the one or more stirrer blades include two or more stirrer blades, and wherein the two or more stirrer blades are arranged in series.

9. The apparatus of claim 6, wherein the one or more stirrer blades include two or more stirrer blades, and wherein the two or more stirrer blades are arranged in parallel.

10. The apparatus of claim 1, further comprising a cooling unit thermally coupled with the mixing chamber.

11. An apparatus comprising:

a support frame comprising a vertical member and a horizontal member;

a mounting unit mounted on the vertical member of the support frame;

a mixing chamber disposed on the horizontal member of the support frame;

a stirrer attached to the mounting unit;

a squeezer unit attached to the mounting unit; and a driving unit coupled to the mounting unit and operable to position the mounting unit along the vertical member of the support frame such that one of the stirrer and the squeezer unit are positioned with respect to the mixing chamber, wherein the squeezer unit is semispherical in shape.

12. The apparatus of claim 11, further comprising a controller coupled to the stirrer and operable to rotate the stirrer about a rotational axis of the stirrer.

13. The apparatus of claim 11, wherein the drive unit is operable to rotate the mounting unit around the vertical member of the support frame in a horizontal plane.

14. The apparatus of claim 11, wherein the drive unit is operable to move the mounting unit along the vertical member of the support frame in a vertical direction.

15. The apparatus of claim 11, wherein the stirrer comprises a stirrer shaft and one or more stirrer blades affixed on the stirrer shaft.

16. The apparatus of claim 11, further comprising a cooling unit thermally coupled with the mixing chamber.

* * * * *